US008678099B2

(12) United States Patent
McLeod et al.

(10) Patent No.: US 8,678,099 B2
(45) Date of Patent: Mar. 25, 2014

(54) SEALING SYSTEM

(75) Inventors: Iain McLeod, Aberdeen (GB); Lee Mercer, Aberdeen (GB)

(73) Assignee: Petrowell Limited, Aberdeen (GB)

( * ) Notice: Subject to any disclaimer, the term of this patent is extended or adjusted under 35 U.S.C. 154(b) by 1309 days.

(21) Appl. No.: 11/570,335

(22) PCT Filed: Apr. 11, 2005

(86) PCT No.: PCT/GB2005/001391

§ 371 (c)(1),
(2), (4) Date: Apr. 16, 2007

(87) PCT Pub. No.: WO2005/121498

PCT Pub. Date: Dec. 22, 2005

(65) Prior Publication Data

US 2007/0261863 A1 Nov. 15, 2007

(30) Foreign Application Priority Data

Jun. 11, 2004 (GB) ..... 0413042.3

(51) Int. Cl.
*E21B 33/12* (2006.01)

(52) U.S. Cl.
USPC ..... 166/387; 166/202; 166/136; 277/341

(58) Field of Classification Search
USPC ..... 277/341, 342
See application file for complete search history.

(56) References Cited

U.S. PATENT DOCUMENTS

| | | | | |
|---|---|---|---|---|
| 643,358 | A | | 2/1900 | Konold |
| 2,009,322 | A | | 7/1935 | Emil |
| 2,181,748 | A | | 11/1939 | Thaheld |
| 2,214,121 | A | * | 9/1940 | Costello ..... 166/147 |
| 2,498,791 | A | | 2/1950 | Clark |
| 2,546,377 | A | | 3/1951 | Turechek |
| 2,564,198 | A | * | 8/1951 | Elkins ..... 73/152.18 |
| 2,738,018 | A | | 3/1956 | Lynes |
| 2,832,418 | A | | 4/1958 | Baker |
| 2,884,070 | A | | 4/1959 | Potts |
| 3,066,738 | A | | 12/1962 | Myers |
| 3,087,552 | A | | 4/1963 | Graham |
| 3,167,127 | A | | 1/1965 | Sizer |

(Continued)

FOREIGN PATENT DOCUMENTS

| | | |
|---|---|---|
| DE | 3812211 | 11/1989 |
| DE | 19827708 | 1/1999 |

(Continued)

OTHER PUBLICATIONS

International Search Report for PCT/GB2009/000730, Sep. 24, 2009.

(Continued)

*Primary Examiner* — William P Neuder
*Assistant Examiner* — Kipp Wallace
(74) *Attorney, Agent, or Firm* — Wong, Cabello, Lutsch, Rutherford & Brucculeri LLP

(57) ABSTRACT

A sealing system and method for sealing a tubular conduit, the sealing system includes a housing, at least one annular seal surrounding the outer surface of the housing, at least one seal back-up mounted on the housing outer surface, and seal and anchor energising means for urging the annular seal and the anchor surface into contact with the tubular conduit in response to an actuation force.

24 Claims, 6 Drawing Sheets

(56) References Cited

U.S. PATENT DOCUMENTS

| | | | | | |
|---|---|---|---|---|---|
| 3,167,128 | A | | 1/1965 | Sutliff | |
| 3,283,821 | A | | 11/1966 | Brown | |
| 3,342,268 | A | | 9/1967 | Brown | |
| 3,371,716 | A | | 3/1968 | Current | |
| 3,482,889 | A | | 12/1969 | Cochran | |
| 3,623,551 | A | | 11/1971 | Randermann | |
| 3,722,588 | A | | 3/1973 | Tamplen | |
| 3,729,170 | A | | 4/1973 | Lewis | |
| 3,889,750 | A | | 6/1975 | Mullins | |
| 4,046,405 | A | | 9/1977 | Bonds | |
| 4,050,517 | A | * | 9/1977 | Matthews | 166/387 |
| 4,127,168 | A | | 11/1978 | Hanson | |
| 4,165,084 | A | * | 8/1979 | Kempf | 277/439 |
| 4,317,485 | A | | 3/1982 | Ross | |
| 4,331,315 | A | | 5/1982 | Geisow | |
| 4,346,919 | A | | 8/1982 | Morrill | |
| 4,349,204 | A | * | 9/1982 | Malone | 277/334 |
| 4,375,240 | A | | 3/1983 | Baugh | |
| 4,545,433 | A | * | 10/1985 | Wambaugh | 166/105 |
| 4,588,030 | A | | 5/1986 | Blizzard | |
| 4,917,187 | A | | 4/1990 | Burns | |
| 2,230,447 | A | | 2/1991 | Bassinger | |
| 5,058,684 | A | | 10/1991 | Winslow | |
| 5,095,978 | A | | 3/1992 | Akkerman | |
| 5,261,488 | A | | 11/1993 | Gullet | |
| 5,542,473 | A | | 8/1996 | Pringle | |
| 6,062,309 | A | | 5/2000 | Gosse | |
| 6,315,041 | B1 | | 11/2001 | Carlisle | |
| 7,690,424 | B2 | | 4/2010 | MacLeod | |
| 2003/0000607 | A1 | | 1/2003 | Jenner | |
| 2004/0055757 | A1 | | 3/2004 | Beall | |
| 2004/0256115 | A1 | * | 12/2004 | Vincent et al. | 166/387 |
| 2005/0224227 | A1 | | 10/2005 | Hendrie | |
| 2009/0308592 | A1 | | 12/2009 | Mercer | |

FOREIGN PATENT DOCUMENTS

| | | |
|---|---|---|
| EP | 0468668 | 1/1992 |
| EP | 0485080 | 5/1992 |
| EP | 1408195 | 4/2004 |
| GB | 755082 | 8/1956 |
| GB | 1257790 | 12/1971 |
| GB | 1364054 | 8/1974 |
| GB | 2118659 | 11/1983 |
| GB | 2224526 | 5/1990 |
| GB | 2245624 | 8/1992 |
| GB | 2328230 | 2/1999 |
| GB | 2428708 | 2/2007 |
| WO | WO 02/42672 | 5/2002 |
| WO | WO 2005/026494 | 3/2005 |
| WO | WO2005121498 | 12/2005 |
| WO | WO 2006/046075 | 5/2006 |
| WO | WO 2007/109878 | 10/2007 |

OTHER PUBLICATIONS

Written Opinion for PCT/GB2009/000730, Sep. 18, 2010.
Office Action, Applicant's co-pending U.S. Appl. No. 11/909,820, filed Oct. 7, 2010.
International Search Report for PCT/GB2009/000770, Oct. 8, 2009.
Written Opinion for PCT/GB2009/000770, Sep. 29, 2010.
Pursuant to MPEP § 2001.6(b) applicants bring the following co-pending applications to the Examiner's attention: U.S. Appl. Nos. 12/933,053, and 12/933,015.
International Search Report, PCT/GB2005/001391, Jun. 23, 2005.
Written Opinion, PCT/GB2005/001391, Jun. 29, 2005.
Int'l Prelim. Report on Patentability, PCT/GB2005/001391, Dec. 14, 2006.
pct-gb2005-004200, Written Opinion, Apr. 10, 2006.
pct-gb2005-004200, Int'l Prelim. Report on Patentability, May 1, 2007.
pct-gb2005-004200, International Search Report, Jan. 11, 2006.
pct-gb2005-003871 Int'l Prelim. Report on Patentability, Sep. 11, 2007.
pct-gb2005-003871, International Search Report, Nov. 17, 2005.
Office Action dated Mar. 30, 2009, Applicant's co-pending U.S. Appl. No. 11/816,421, Mar. 30, 2009.
Office Action dated Sep. 28, 2009, Applicant's co-pending U.S. Appl. No. 11/816421, Sep. 28, 2009.
petr103-oa-uk-20051101, Foreign Office Action dated Nov. 1, 2005.
pct-gb2005-003871, Written Opinion, Nov. 22, 2005.
pctgb2006001297, Int'l Prelim. Report on Patentability and Written Opinion, Oct. 9, 2007.
pctgb2006001297, International Search Report, Oct. 9, 2007.
Office Action dated May 29, 2009, Applicant's co-pending U.S. Appl. No. 11/909,820, filed May 29, 2009.
Office Action dated Feb. 17, 2010, Applicant's co-pending U.S. Appl. No. 11/909,820, filed Feb. 19, 2010.
pctgb2007001040, International Search Report, Jun. 5, 2010.
pctgb2007004372, Int'l Prelim. Report on Patentability and Written Opinion, May 19, 2009.
pctgb2007004372, International Search Report, Jan.23, 2008.
pctgb2008002042, Int'l Prelim. Report on Patentability and Written Opinion, Dec. 20, 2009.
pctgb2008002042, International Search Report, Oct. 17, 2008.
pctgb2009071874, Int'l Prelim. Report on Patentability and Written Opinion, Jun. 8, 2010.
pctgb2009071874, International Search Report, Jul. 23, 2009.
pct-gb2008003883, Int'l Prelim. Report on Patentability and Written Opinion, May 25, 2010.
pctgb2008003883, International Search Report, Mar. 26, 2009.
PCTGB200900048300, Int'l Prelim. Report on Patentability and Written Opinion, Aug. 24, 2010.
PCTGB200900048300, International Search Report, Sep. 28, 2009.
Office Action dated Aug. 25, 2010, Applicant's co-pending U.S. Appl. No. 11/577,866, filed Aug. 25, 2010.
Pursuant to MPEP § 2001.6(b) applicants bring the following co-pending application to the Examiner's attention: U.S. Appl. No. 12/866,495.
Pursuant to MPEP § 2001.6(b) applicants bring the following co-pending application to the Examiner's attention: U.S. Appl. No. 12/743,397.
Pursuant to MPEP § 2001.6(b) applicants bring the following co-pending application to the Examiner's attention: U.S. Appl. No. 12/743,505.
Pursuant to MPEP § 2001.6(b) applicants bring the following co-pending application to the Examiner's attention: U.S. Appl. No. 12/665,641.
Pursuant to MPEP § 2001.6(b) applicants bring the following co-pending application to the Examiner's attention:U.S. Appl. No. 12/514,488.
Pursuant to MPEP § 2001.6(b) applicants bring the following co-pending application to the Examiner's attention: U.S. Appl. No. 12/294,078.
Pursuant to MPEP § 2001.6(b) applicants bring the following co-pending application to the Examiner's attention: U.S. Appl. No. 11/909,820.
Pursuant to MPEP § 2001.6(b) applicants bring the following co-pending application to the Examiner's attention: U.S. Appl. No. 11/816,421.
Pursuant to MPEP § 2001.6(b) applicants bring the following co-pending application to the Examiner's attention: U.S. Appl. No. 11/577,866.
Office Action dated May 4, 2011, received from the Canadian Intellectual Property Office.

* cited by examiner

SEALING SYSTEM

FIELD OF THE INVENTION

This invention relates to a sealing system for sealing a tubular conduit, particularly to seals for use in the oil and gas industry.

BACKGROUND TO THE INVENTION

Sealing systems are widely used in oil and gas extraction wells to provide a barrier to well fluids, well treatments, well interventions and well pressure. Some sealing systems are designed to seal a bore and others to provide a barrier or seal in the annulus between two seals, for example, straddling a leak in the production pipe.

In certain environments the sealing system is designed to be run through a narrow bore prior to locating and operating within a wider bore. Such systems are known as "through tubing" sealing systems. These applications often deem that the device is required to operate in a well bore greater than 15% of its original diameter. Such systems are known as "high expansion through tubing" sealing systems.

Conventional "through tubing" sealing systems have four basic parts; a sealing element, a seal backup system, an anchoring system and a setting system.

Conventional mechanical "through tubing" solutions have a combined sealing & back up system and a separate anchor system. Each of these systems is activated by linear displacement, requiring the provision of a setting facility. In "high expansion through tubing" applications, the setting facility is often an extended stroke, bespoke device. Additionally, as the anchoring and sealing systems are independent, the load applied to the cased bore by the seal does not directly contribute to the anchor performance and vice versa.

A further disadvantage of conventional mechanical "through tubing" seals is that they rely on the initial pack off force applied to the sealing element in order to generate an effective seal. As well temperatures and pressures change, this induces changes to sealing forces. In the event that the seal pressure reduces due to cooling of the well bore, the performance of the seal may be compromised.

An alternative solution to conventional mechanically deployed "through tubing" seals are inflatable "through tubing" seals. These seals use an inflate medium to expand the seal in preference to mechanical displacement. In these systems, the integrity of the setting medium varies due to its chemical, thermal and mechanical response to the changing well environment. Changes in the properties of the inflate medium effect sealing and anchoring performance. Inflatable solutions, even when fully functional, are often low pressure sealing solutions.

It is an object of the present invention to obviate or mitigate at least one of the above disadvantages.

SUMMARY OF THE INVENTION

According to a first aspect of the present invention there is provided a sealing system for sealing a tubular conduit, the sealing system including:

a housing having an outer surface;

at least one annular seal surrounding the housing outer surface;

at least one seal backup mounted on the housing outer surface and adjacent the at least one annular seal, the at least one seal backup having an anchor surface, and seal and anchor energising means for urging the annular seal and said anchor surface into contact with the tubular conduit in response to an actuation force whereby, once energised, a first portion of the annular seal forms a contact seal with the tubular conduit and a second portion of the annular seal presses the anchor surface to maintain contact between the anchor surface and the tubular conduit.

The anchor surface provides a secure anchor to the tubular conduit. By providing an anchor surface on the at least one seal backup, a separate anchor is not essential. This has a number of advantages over conventional through tubing seal systems, for example, the displacement necessary to set the seal in place is reduced and the overall length of the system being used to carry the seal is also reduced.

Preferably, when energised the seal forms a "cup" or "lip" contact seal with the tubular conduit.

Preferably, when energised the at least one annular seal has a diverging cross section extending from the housing outer surface to the tubular conduit. A diverging cross-section facilitates the forming of a contact seal with the tubular conduit. The diverging geometry also facilitates energization of the seal when pressure is applied.

Preferably, the at least one annular seal is self-energising. Self energising means that once the seal has made a contact seal with the tubular conduit, pressure applied to the seal system by the internal pressure within the tubular conduit, or annulus, forces the first portion of the at least one annular seal into tighter engagement with the tubular conduit and the second portion of the at least one annular seal to press the at least one seal backup anchor surface into tighter engagement with the tubular conduit wall.

Preferably, the seal backup comprises a series of interleaved elements.

Preferably, the interleaved elements are mounted externally onto the at least one annular seal or bonded into the at least one annular seal. The interleaved elements, like the petals on a closed flower, allow the at least one seal backup to expand sufficiently for the anchor surface to engage with the tubular conduit.

Preferably the at least one seal backup comprises an inner seal backup and an outer seal backup.

Preferably, both the inner seal backup and the outer seal backup comprise a series of interleaved elements. The inner seal backup and the outer seal backup are offset with respect to each other so that the leaved elements of the inner seal backup overlap the gaps left between the leaved elements of the outer seal backup as the interleaved elements open during the expansion of the at least one annular seal.

Preferably, the seal and anchor energising means includes an axially moveable sleeve mounted around the housing outer surface. An axially moveable sleeve facilitates applying an even pressure to expand the at least one seal around the entire circumference of the housing.

Preferably, the seal and anchor energising means further includes at least one spring element mounted to the housing outer surface adjacent the at least one annular seal. A spring element is used to transfer the axial displacement of the setting means to radial expansion of the at least one annular seal. The spring element also retains spring energy on the seal in order to keep it in sealing contact with the conduit wall.

Preferably, the at least one spring element is a beam spring.

Preferably, there are two annular seals, two seal backups and two sets of beam springs. Two annular seals, two seal backups and two sets of beam springs allow the sealing system to withstand pressures both above and below the seal system.

Preferably, each set of beam springs comprises a plurality of overlapping beam springs. The overlapping beam springs may be arranged axially with respect to the housing. Alternatively, the overlapping beam springs may be arranged helically with respect to the housing. Each set of overlapping beam springs may comprise an outer and inner layer of beam springs. The outer and inner layers may be arranged concentrically. Where the overlapping beam springs are arranged helically with respect to the housing, the outer layer of beam springs may be arranged with a different helical angle to the inner layer of beam springs.

Preferably, the housing defines a throughbore. Alternatively, the housing is of solid cross section. If the housing defines a throughbore, hydrocarbons from below the seal will be able to flow to surface through the throughbore. In the alternative case, a housing of solid cross-section can be used to seal the tubing.

Preferably, the seal system includes energy storing means for storing energy into the system after setting operation of the seal system is completed and to take up slack generated in the seal system by fluctuations in internal pressure and temperature in the tubular conduit.

Preferably, the energy storing means is provided by the beam springs.

Preferably, the at least one annular seal is an elastomeric seal. Alternatively, the at least one annular seal is a plastic seal, a metal seal or a composite seal.

According to a second aspect of the present invention there is provided a method of sealing a tubular conduit by a sealing system and anchoring the sealing system in the sealed tubular conduit, said method comprising the steps of:

applying an axial load, converting the axial load into a radial load;

applying the radial load to an annular sealing element and to an anchor surface via said annular sealing element;

whereby the radial load is used to create a contact seal with said tubular conduit and simultaneously anchor the sealing system to the tubular conduit via the anchor surface.

According to a third aspect of the present invention there is provided a seal back up for use in a sealing system for sealing a tubular conduit, the seal back up having an anchor surface for engaging the tubular conduit.

Preferably, the seal backup comprises a series of interleaved elements.

Preferably the seal backup comprises an inner seal backup and an outer seal backup.

Preferably, part of the outer seal backup defines the anchor surface.

The anchor surface provides a secure anchor to the tubular conduit to ensure the seal system cannot move under pressure.

Preferably, both the inner seal backup and the outer seal backup comprise a series of interleaved elements.

Preferably, the outer and inner seal back ups are made from metal. Alternatively the outer and inner seal back ups are made from plastic, a composite or an elastomeric.

According to a fourth aspect of the present invention there is provided a spring element for use in a sealing system for sealing a tubular conduit.

Preferably, the spring element is a beam spring.

According to a fifth aspect of the present invention there is provided a sealing system for sealing a tubular conduit including at least one combined seal back up and anchor device.

By virtue of the present invention a tubular conduit may be sealed by a high expansion through tubing sealing system incorporating a combined seal back up and anchor.

BRIEF DESCRIPTION OF THE DRAWINGS

These and other aspects of the present invention will now be described by way of example only with reference to the accompanying drawings in which.

DETAILED DESCRIPTION OF THE DRAWINGS

Figure 1:
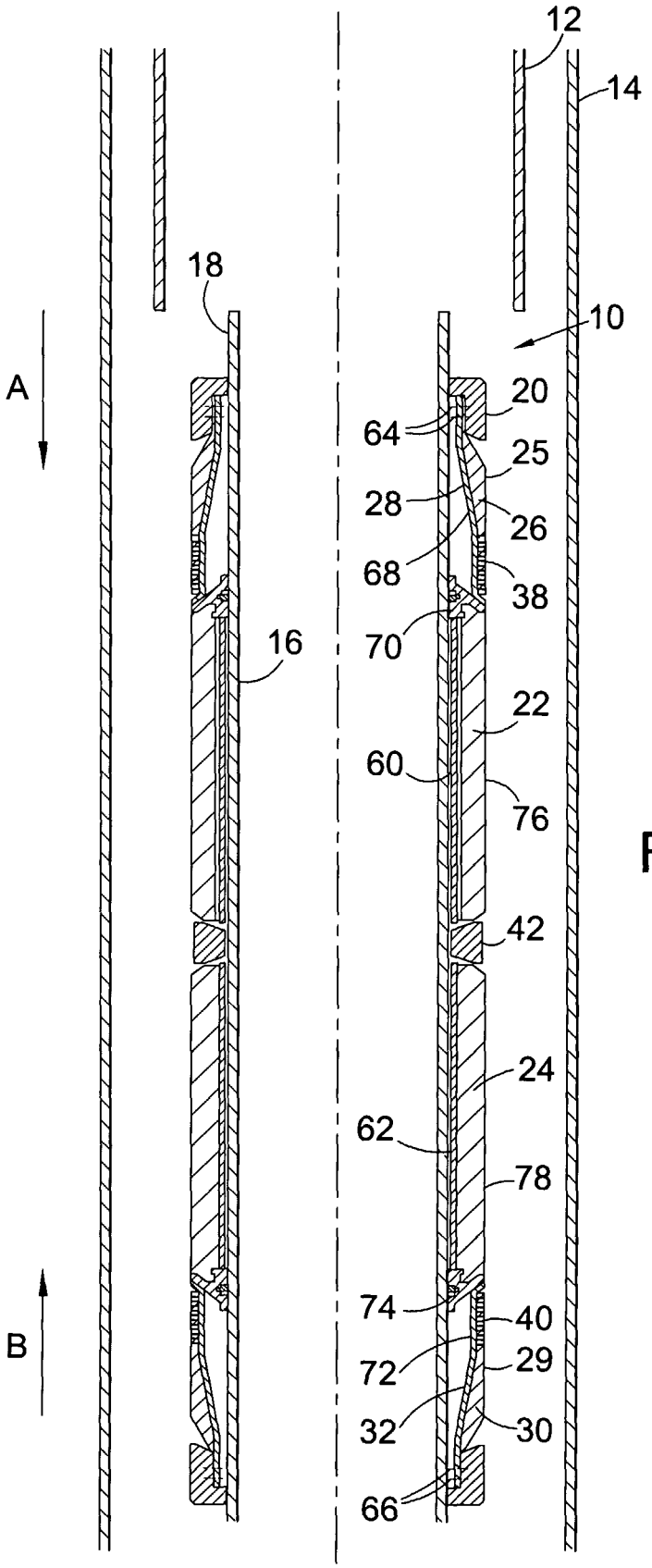
FIG. 1 shows a cut-away side view of a sealing system in run-in configuration in accordance with a first embodiment of the present invention.
Figure 2:
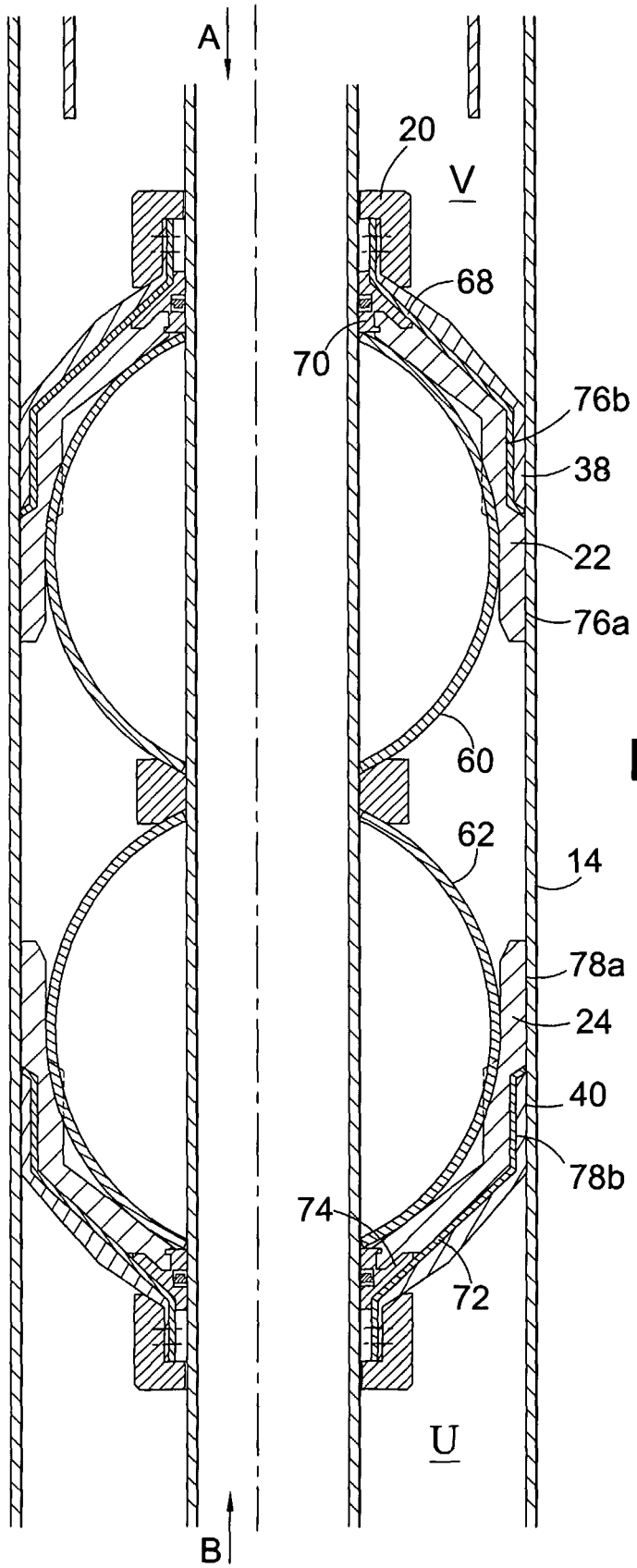
FIG. 2 shows a cut-away side view of the sealing system of FIG. 1 in sealing configuration.

Referring to FIGS. 1 and 2, there is shown a cut-away side view of a sealing system 10 in according to a first embodiment of the present invention. The sealing system 10 has been run through tubing 12 into cased bore 14. The sealing system 10 comprises a cylindrical housing 16 having an outer surface 18, a setting sleeve 20, a first annular seal 22, having a sealing surface 76, and a second annular seal 24, having a sealing surface 78.

Figure 3A:
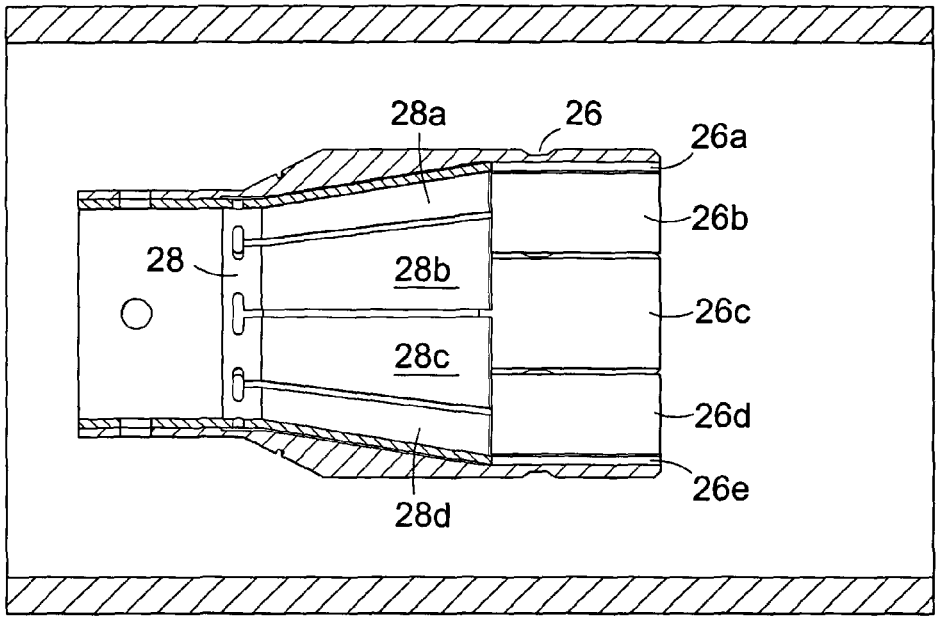
FIG. 3*a* shows a cut-away side view of a seal back up of FIG. 1 in run-in configuration.
Figure 3B:
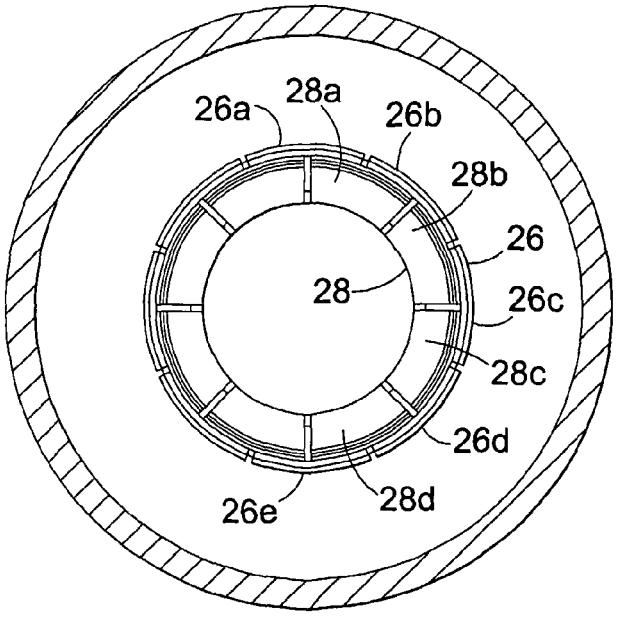
FIG. 3*b* shows an end view of the seal back up of FIG. 3*a;*

The sealing system 10 also includes a first seal back-up 25 associated with the first annular seal 22 comprising a first outer seal backup 26 and a first inner seal backup 28, and a second seal back up 29 associated with the second annular seal 24 comprising a second outer seal backup 30 and a second inner seal backup 32. The first seal back up 25 is shown in FIGS. 3*a* and 3*b* in the run in condition, i.e. the pre-deployment position also shown in FIG. 1. Both the first outer seal back up 26 and the first inner seal back up 28 are made up of a number of overlapping leaved elements. In FIG. 3*a* five leaves 26*a-e* of the first outer seal backup 26 are shown, which overlap the gaps between the four leaves 28*a-d* of the inner seal backup 28 which are shown. It will be understood any number of leaves could be used and the leaves extend around the circumference of the housing outer surface 18. In FIGS. 3*a* and 3*b* the inner leaves 28*a-d* are truncated for clarity, in reality they would extend to a similar length to the outer leaves 26*a-e*. The second seal backup 29 is of similar construction to the first seal backup 25.

Figure 4:
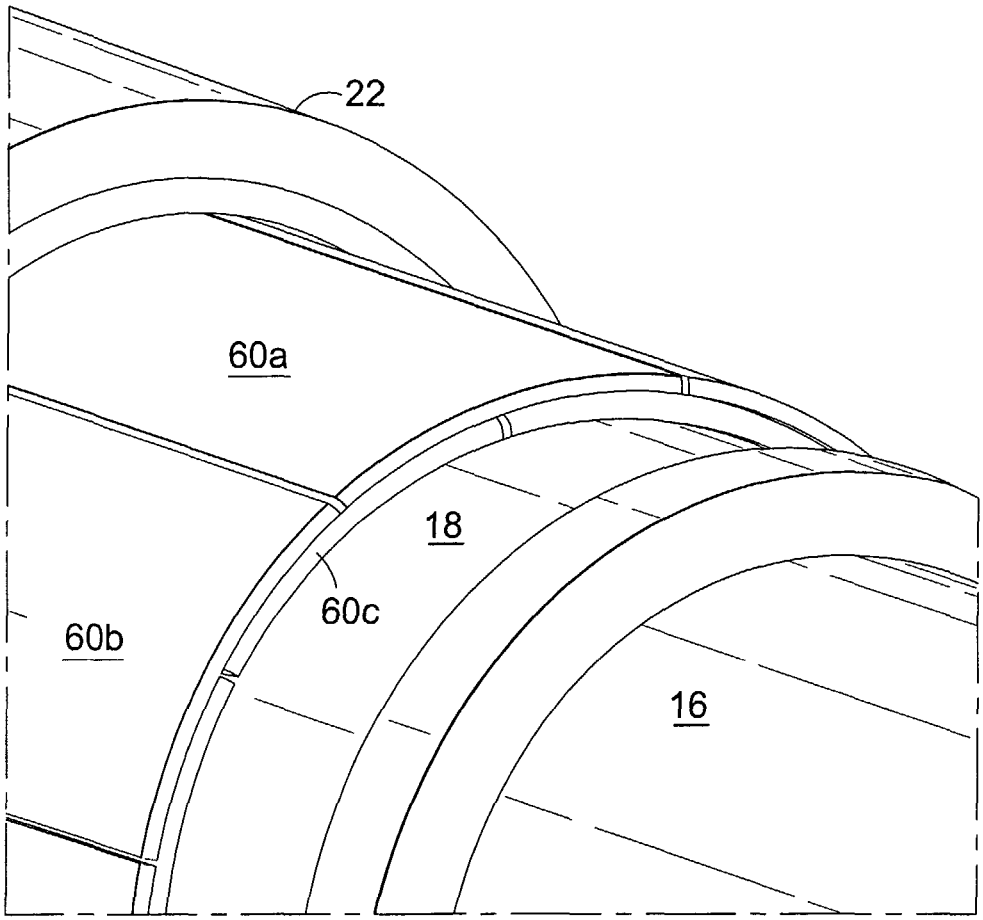
FIG. 4 shows a perspective cut-away view of part of the sealing system of FIG. 1.
Figure 5:
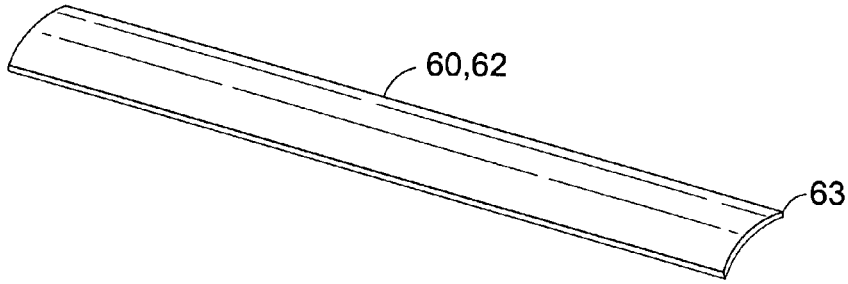
FIG. 5 shows a perspective view of a beam spring.

First beam springs 60 are shown in FIG. 4, a perspective cut away view of part of the sealing system of FIG. 1. First beam springs 60 are sandwiched between the first annular seal 22 and the housing outer surface 18. Similarly, second beam springs 62 are sandwiched between the second annular seal 24 and the housing outer surface 18. The first beam springs 60 are interleaved such that when the first annular seal 22 is deployed and the beam springs arch outwards, as shown in FIG. 2, the gap created between beam springs 60*a* and 60*b* is, at least partially, filled by beam spring 60*c*. The first beam springs 60 are arranged axially with respect to the housing 16. As shown in FIG. 5, a perspective view of a beam spring, each beam spring 60,62 is a rectangular member of arcuate cross-section 63. The arrangement of the second beam springs 62 is the same as the arrangement of the first beam springs 60.

Positioned between the first and second annular seals 22,24 is a load transfer sub 42. The first annular seal 22 is retained in position by a retainer 70, and the second annular seal 24 is retained in position by retainer 74.

The first outer seal backup 26 and the second outer seal backup 30 both have anchor seal surfaces 38,40 respectively for anchoring the sealing system 10 to the cased bore 14 when the seals 22,24 are activated.

The first seal back up 25 is retained in the position shown in FIG. 1 by means of shear screws 64. The second seal back up 29 is retained in the position shown in FIG. 1 by means of fixed position screws 66.

To activate the sealing system, the setting sleeve 20 is moved axially down the cased bore 14 with respect to the housing 16 in the direction of arrow A under the action of an industry standard setting device (not shown). This applied load shears the shear screws 64 forcing the first seal backup 25 radially outwards and over the seal retainer 70 and the first annular seal 22 until the inner face 68 of the first inner seal back up 28 meets the retainer 70 of the first annular seal 22.

Figure 3C:
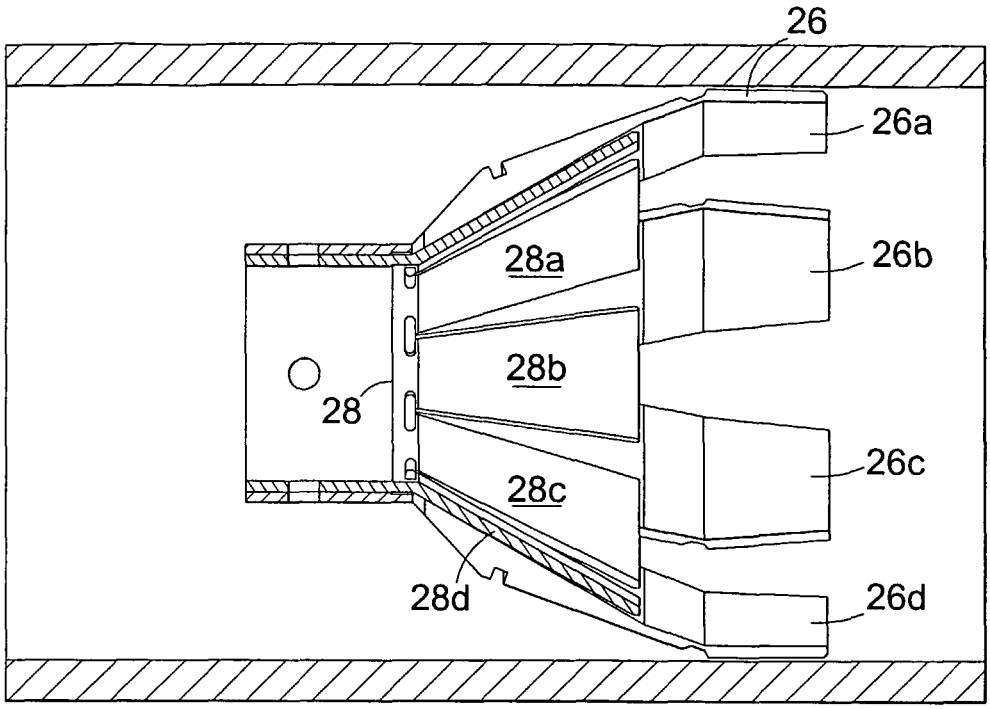
FIG. 3*c* shows the seal backup of FIG. 3*a* in deployed configuration.
Figure 3D:
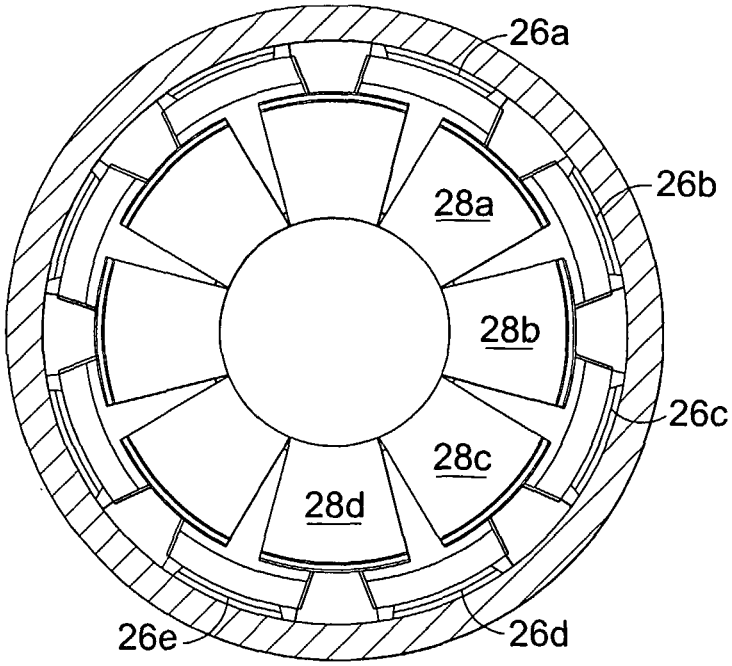
FIG. 3*d* shows an end view of the seal back up of FIG. 3*c;*

At this point the first seal back up 25 is deployed and the anchor surface 38 of the first outer seal back up 26 engages with the cased bore 14. In FIGS. 3*c* and 3*d* the overlapping arrangement of four of the leaves 26*a-d* of the first outer seal backup 26 and the leaves 28*a-d* of the first inner seal backup 28 in the deployed position can be seen.

Referring back to FIGS. 1 and 2 when the inner face 68 of the first inner seal back up 28 engages the retainer 70 of the first annular seal 22 the axial load is transferred into the first beam springs 60 deforming the beam springs 60 and forcing seal 22 radially outwards, such that one part of the sealing surface, 76*a*, forms a contact seal against the cased bore 14 and another part of the sealing surface, 76*b*, presses the anchor surface 38 against the cased bore 14.

Once the first seal 22 and the first seal back up 25 are deployed as shown in FIG. 2, no further axial movement in the direction of arrow A can be achieved, permitting the housing 16 and second back up 29 to move axially up the cased bore 14 in the direction of arrow B under the action of an industry standard setting device (not shown). The applied axial load forces the outer housing 16 up and as the second seal back up 29 is fixed to the outer housing 16 via screws 66 the second seal backup 29 is forced radially outward and over the seal retainer 74 and the second annular seal 24 until the inner face 72 of the second inner seal back up 32 engages the retainer 74 of the second annular seal 24. At this point the second seal back up 29 is deployed and the anchor surface 40 of the second outer seal back up 30 is engaged with the cased bore 14. The upwards axial load is then transferred to the beam spring 62 as shown in FIG. 2 which deforms to force the annular seal 24 radially outwards, such that one part of the sealing surface, 78*a*, forms a contact seal against the cased bore 14 and another part of the sealing surface, 78*b*, presses the anchor surface 40 against the cased bore 14. Once the second seal 24 and back up 29 are formed no further movement in the direction of arrow B or A can be achieved and the setting procedure is complete, and the setting tool (not shown) disengages from the sealing system 10.

The deployed sealing system 10 shown in FIG. 2 can withstand pressure from both upwards and downwards directions, i.e. A & B axial directions, indeed, pressure increases will energize the seals 22,24 to improve the seal with the cased bore 14 and to increase the pressure holding the anchor surfaces 38,40 in contact with the cased bore 14.

It will be understood that the second annular seal 24 seals the well from pressure applied to the sealing system from annular cavity V on FIG. 2, and the first annular seal 22 contains the pressure in annular cavity U on FIG. 2. Fluctuations in pressure creating slack in the system, which may lessen the effect of the seal, are compensated by the spring energy in the first and second beam spring units 60,62 which maintains a contact pressure on the sealing surfaces 76,78 and the anchor surfaces 38,40.

Figure 6:
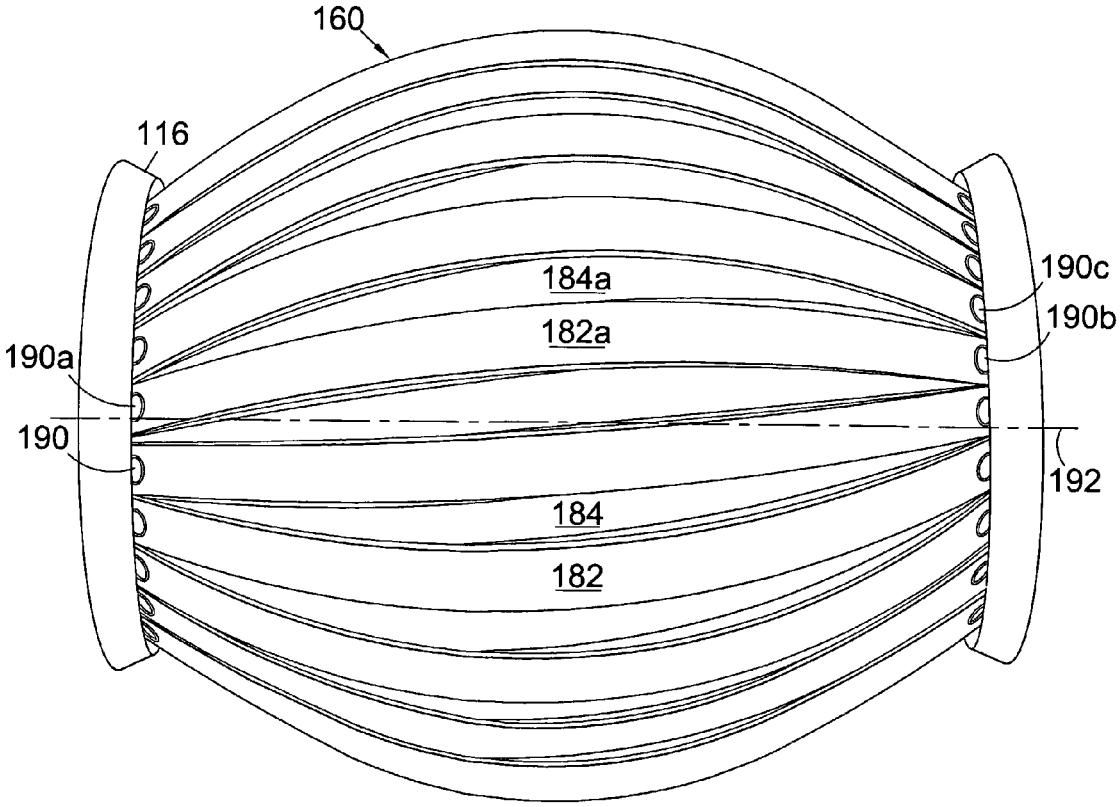
FIG. 6 shows a cut-away plan view of part of a sealing system according to a second embodiment of the present invention.

Referring now to FIG. 6 there is shown a cut-away plan view of part of a sealing system according to a second embodiment of the present invention. This figure shows an alternative arrangement of a first set beam springs 160 in an expanded configuration. In this embodiment the beam springs 160 are arranged helically with respect to the housing 116.

The first set of beam springs 160 comprise an outer layer 182 and an inner layer 184 (for clarity only one outer layer spring and one inner layer spring are indicated). The outer and inner layers 182, 184 are connected by studs 190 and are overlapping so that in the expanded configuration, shown in FIG. 6, the gap between adjacent outer layer springs 182 is substantially filled by an inner layer spring 184.

The inner layer springs 184 are arranged at a greater helical angle, with respect to the housing axis 192, than the outer layer springs 182, referring to FIG. 6, outer spring "182*a*" extends between studs "190*a*" and "190*b*", and inner spring "184*a*" extends between studs "190*a*" and "190*c*".

It will be understood the sealing system of FIG. 6 includes a second set of beam springs, which are not shown for clarity, and will be similarly arranged.

Various modifications and improvements may be made to the embodiments hereinbefore described without departing from the scope of the invention. For example, although a double seal is described, the system can be used with a single seal and single seal back up for withstanding pressure from only one direction, or the beam spring could be a deformable ramp or any other body that could convert linear displacement in to radial displacement.

For the avoidance of doubt, by a tubular conduit it is meant a tubing string, a lined bore such as cased bore, or an unlined bore such as open hole.

Furthermore, although beam springs have been used to move the seal to a cup shape, any suitable means can be used. For example, a material which swells in the completion fluid may be used.

Those of skill in the art will also recognise that the above-described embodiment of the invention provide a sealing system which uses the sealing force to anchor the system in a tubular conduit. This arrangement permits the sealing system to be set by a relatively short displacement of the setting sleeve, allowing for the entire sealing system to be shorter in length than conventional through tubing seal systems. The use of beam springs ensures the integrity of the seal is not affected by variations in well pressure, a known problem in some conventional through tubing seals. Furthermore, applied pressure on the sealing system increases sealing and anchoring performance.

The sealing system is compatible with existing equipment for example, industry standard stroke setting tools can be used.

Additionally the sealing system is extremely versatile, for example the design may be used to seal a range of diameters from D to 2×D, where D is the outside diameter of the seal.

Finally, the sealing system's slim cross section allows housing to be solid or tubular, i.e. the housing could be designed to permit the passage of hydrocarbons therethrough.

The invention claimed is:

1. A sealing system for sealing a tubular conduit, the sealing system including:

a housing having an outer surface;

at least one annular seal surrounding the housing outer surface;

at least one seal backup mounted on the housing outer surface and adjacent the at least one annular seal, the at least one seal backup having an anchor surface; and seal and anchor energising means for urging the annular seal and said anchor surface into contact with the tubular conduit in response to an actuation force whereby, once energised, a first portion of the annular seal forms a cup contact seal with the tubular conduit and a second portion of the annular seal presses the anchor surface to maintain contact between the anchor surface and the tubular conduit, such that pressure applied to the system further energises the seal, and wherein the seal and anchor energising means comprises a plurality of overlapping beam springs.

2. The sealing system of claim 1, wherein, when energised, the at least one annular seal has a diverging cross section extending from the housing outer surface to the tubular conduit.

3. The sealing system of claim 1, wherein the seal backup comprises a series of interleaved elements.

4. The sealing system of claim 3, wherein the interleaved elements are mounted externally onto the at least one annular seal.

5. The sealing system of claim 3, wherein the interleaved elements are bonded into the at least one annular seal.

6. The sealing system of claim 1, wherein the at least one seal backup comprises an inner seal backup and an outer seal backup.

7. The sealing system of claim 6, wherein both the inner seal backup and the outer seal backup comprise a series of interleaved elements.

8. The sealing system of claim 6, wherein the inner seal backup and the outer seal backup are offset with respect to each other.

9. The sealing system of claim 1, wherein the seal and anchor energising means includes an axially moveable sleeve mounted around the housing outer surface.

10. The sealing system of claim 9, wherein the plurality of overlapping beam springs are mounted to the housing outer surface adjacent the at least one annular seal.

11. The sealing system of claim 10, wherein there are two annular seals, two seal backups and two sets of beam springs.

12. The sealing system of claim 11, wherein the beam springs are arranged axially with respect to the housing.

13. The sealing system of claim 11, wherein the beam springs are arranged helically with respect to the housing.

14. The sealing system of claim 11, wherein each set of overlapping beam springs comprises an outer layer and an inner layer of beam springs.

15. The sealing system of claim 14, wherein the outer layer and inner layer are arranged concentrically.

16. The sealing system of claim 13 wherein the outer layer of beam springs are arranged with a different helical angle to the inner layer of beam springs, and wherein each set of overlapping beam springs comprises an outer layer and an inner layer of beam springs.

17. The sealing system of claim 1, wherein the housing defines a throughbore.

18. The sealing system of claim 1, wherein the housing is of solid cross section.

19. The sealing system of claim 1, wherein the seal system includes energy storing means.

20. The sealing system of claim 11, wherein the seal system includes energy storing means, and wherein the energy storing means is provided by the beam springs.

21. The sealing system of claim 1, wherein the tubular conduit is a cased bore.

22. The sealing system of claim 1, wherein the tubular conduit is a tubing string.

23. The sealing system of claim 1, wherein the tubular conduit is an open hole.

24. A method of sealing a tubular conduit by a sealing system and anchoring the sealing system in the sealed tubular conduit, said method comprising the steps of:

applying an axial load;

converting the axial load into a radial load; and applying the radial load via a plurality of overlapping beam springs to an annular sealing element and to an anchor surface via said annular sealing element;

whereby the radial load is used to create a contact cup seal with said tubular conduit and simultaneously anchor the sealing system to the tubular conduit via the anchor surface, such that pressure applied to the system further energises the seal.

* * * * *

UNITED STATES PATENT AND TRADEMARK OFFICE

CERTIFICATE OF CORRECTION

PATENT NO. : 8,678,099 B2
APPLICATION NO. : 11/570335
DATED : March 25, 2014
INVENTOR(S) : McLeod et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1744 days.

Signed and Sealed this
Twenty-first Day of July, 2015

Michelle K. Lee

Michelle K. Lee
*Director of the United States Patent and Trademark Office*